United States Patent [19]

Tornqvist

[11] Patent Number: 4,592,431

[45] Date of Patent: Jun. 3, 1986

[54] DEVICE FOR DEPOSITION OF THE MOVEMENTS OF TWO DRIVEN BODIES IN THE FORWARD DIRECTION OF A TOOL

[76] Inventor: Peter J. T. Tornqvist, Barkassvagen 11, 181 35 Lidingo, Sweden

[21] Appl. No.: 643,802

[22] Filed: Aug. 22, 1984

[60] Continuation of PCT SE 83/00470 filed Dec. 22, 1983, published as WO 84/02488 on Jul. 5, 1984.

[30] Foreign Application Priority Data

Dec. 22, 1982 [SE] Sweden ..... 82073511

[51] Int. Cl.[4] ..... B25D 17/24

[52] U.S. Cl. ..... 173/103; 173/162 R

[58] Field of Search ..... 173/101–103, 173/116, 133, 134, 162 R, 11, 16, 17

[56] References Cited

U.S. PATENT DOCUMENTS

| | | | |
|---|---|---|---|
| 1,798,642 | 3/1931 | Wadsworth | 173/103 |
| 1,802,987 | 4/1931 | Shook | 173/103 |
| 4,184,357 | 1/1980 | Stubbings | 173/103 |

FOREIGN PATENT DOCUMENTS

| | | |
|---|---|---|
| 48408 | 12/1928 | Norway . |
| 429622 | 9/1983 | Sweden . |

*Primary Examiner*—James M. Meister
*Assistant Examiner*—John L. Knoble
*Attorney, Agent, or Firm*—Frishauf, Holtz, Goodman & Woodward

[57] ABSTRACT

A device to transfer the alternately performed reciprocating movements of two pistons in a forward direction of a tool, the pistons being arranged coaxially about a center axis in a casing with the first piston running at least partly in a bore of the second piston and in sealing relation with the second piston bore. Another part of the first piston extends out of the path of movement of the second piston and is in sealing relation against the interior wall of the casing. The pistons are driven alternately to strike against an impact member common to both pistons which impact member is coaxial with the center axis and mechanically coupled to the tool.

7 Claims, 4 Drawing Figures

DEVICE FOR DEPOSITION OF THE MOVEMENTS OF TWO DRIVEN BODIES IN THE FORWARD DIRECTION OF A TOOL

This is a continuation of International Patent Application No. PCT/SE83/00470, filed in Sweden on Dec. 22, 1983 published as WO 84/02488 on Jul. 5, 1984.

This invention relates to a device for deposition of the reciprocating movements performed alternately by two driven bodies in the forward direction of a tool, the said bodies being located essentially centred around a common centre line with the first body running at least partially in and being during at least a portion of its movement essentially sealed against the other body and against a casing.

Therre has long been a need to reduce the vibrations in or to balance percussive tools in view of the injuries to operators and damage to machines that vibrations can give rise to. For example, many people refrain from using now existing percussive tools on accound of the risk of permanent injury in the form of, for example "white fingers".

A number of more or less complicated, sensitive and costly solutions to this problem have been presented. Certain solutions require, for example, a high feed force to accomplish the devibration and thus impose enormous demands on the operator, which is obviously undesirable, while other solutions use complicated valve devices for reversal of driving force directions, a larger number of springs, which can become fatigued, etc. Examples of known solutions are shown through the Swedish publications laid open for public inspection, No. 7410147-8, 8003177-6 and 7603252-3.

Another disadvantage of the majority of known solutions of devibrated percussive tools is that they usually do not exploit the recoil strike for active work.

The object of the present invention in its general aspect is to provide a device to attain in an uncomplicated and inexpensive manner, without costly steering mechanisms, pistons, springs, which can be fatigued, etc., reduced vibrations and essentially devibration of reciprocating tools.

In a more limited aspect of the present invention the object is to provide a reciprocating percussive tool by means of which both the stroke in the forward direction and the recoil are deposited in the working tool and not partly or entirely in the operator of the tool.

The device according to the invention by means of which the aforesaid and other advantages are attained is characterized by the device mentioned in the introduction to the description in that the bodies are devised and arranged to act as pistons, which are arranged to alternately strike against an impact device which is common to the said pistons and which is centred in relation to the said joint centre line and which is connected mechanically to the said tool.

Figure 1:
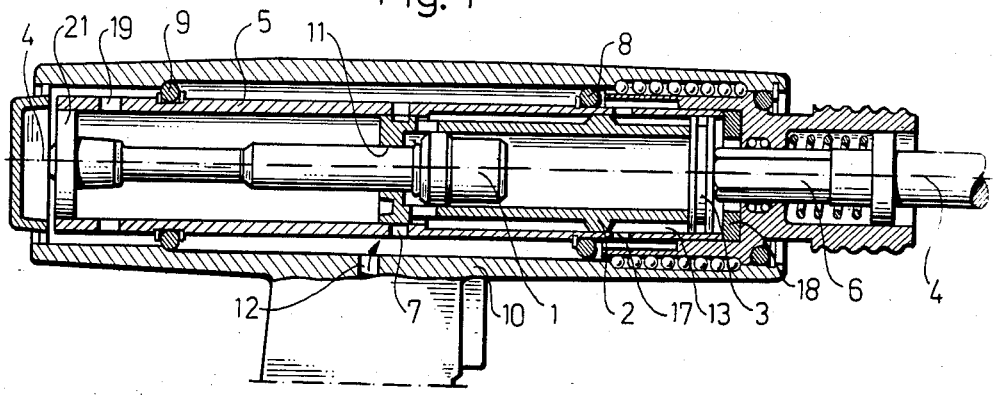
Figure 2:
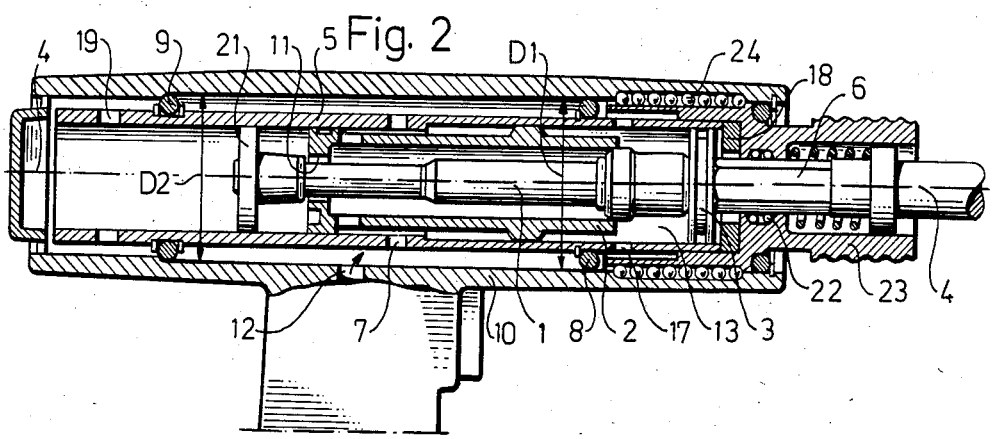
Figure 4:
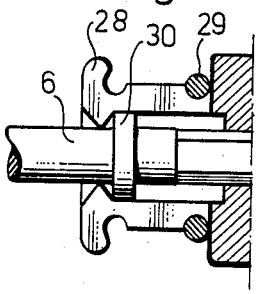
Figure 3:
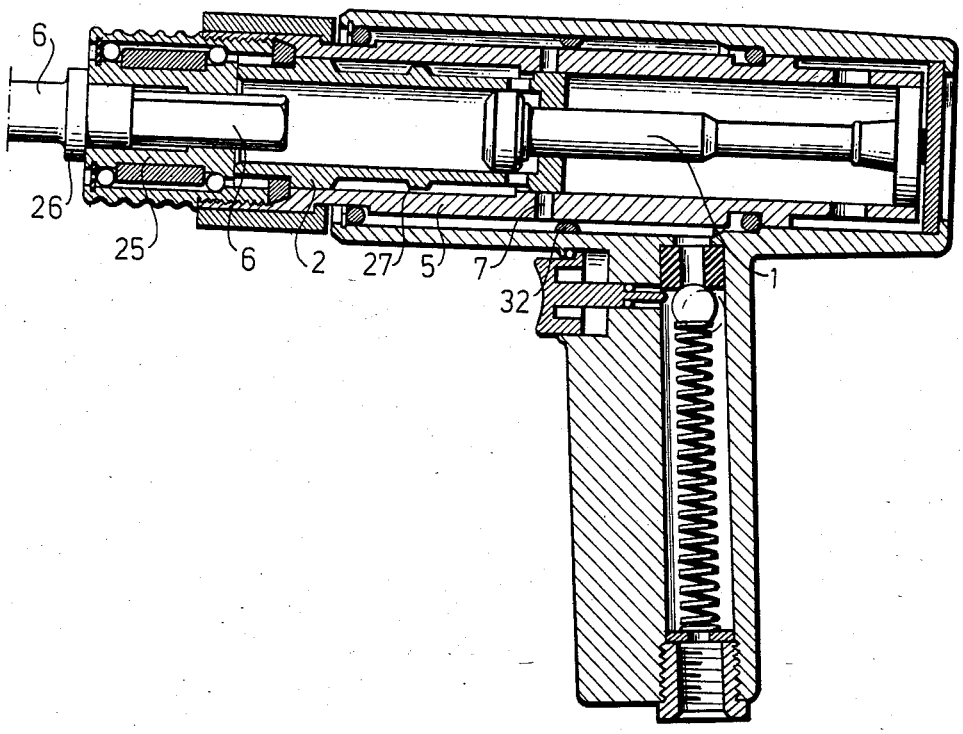

Further details of the invention are evident from the accompanying claims and from the following description with associated drawings, wherein FIG. 1 shows in a sectional view from the side the invention applied to a percussive tool with the striking bodies or pistons in the one reverse position, for example a chisel hammer, FIG. 2 illustrates in in a sectional view from the side the invention according to FIG. 1 with a carried chisel retainer with the striking bodies or pistons in the other reverse position, FIG. 3 shows in a sectional view from the side a modified embodiment of the chisel hammer according to FIG. 1 and 2 and FIG. 4 shows in a sectional view from the side a quick coupling for the working portion, for example a chisel.

In the description and on the drawing the same reference numerals have been used consistently for corresponding parts.

In its general aspect the invention offers an opportunity to prevent the recoil stroke which has occurred hitherto upon transfer of reciprocating masses from being returned to the machine in that the recoil stroke is also caused to be deposited on the working tool in the form of a second working stroke.

In principle, the details which—apart from drive medium—must be provided in order for this to be able to take place are evident from FIG. 1, in which is shown a casing 5, a first body 1 reciprocating in this casing 5, a second body 2 reciprocating in the said casing and a common stop 3 for these bodies. The first body 1 is centred in the second body 2 and the said bodies 1, 2 have a commom centre line 4 around which the masses of the bodies 1, 2 are centred.

Since the two bodies 1, 2 have here been given essentially the same masses the second body 2 will be moved with the same stroke length but in the reverse direction to the first body 1 when these are driven by a drive medium 12, i.e. the movements of the bodies 1 and 2 are counter-directed in relation to each other, these movements occurring simultaneously, and the same masses being moved in mutually opposite directions so that no forces are transmitted to the surroundings, for example to the casing 5, the friction between bodies 1, 2 and between the second body 2 and the casing 5 also being mutually counter-directed so that no essential vibrations dependent of friction are transmitted. In that the bodies 1, 2 and the stop 3 are also centred around the same centre line 4, there will moreover not be any torsional movements in for example the casing 5.

Obviously it is not necessary for the masses of the bodies 1, 2 to be chosen the same but they may differ vastly between themselves. If the masses of the bodies 1, 2 are chosen different then different stroke lengths will be obtained for the two bodies 1, 2. The stop 3, however, always gives a mutual "synchronization" of the bodies 1 and 2.

The percusive tool illustrated as an example in FIG. 1 exists in the form of a chisel hammer in which the strokes of both bodies or pistons 1, 2 are deposited against the stop 3 and thus against a working chisel 6.

In the percussive tool illustrated in FIG. 1, this tool is equipped with the said chisel 6, which is in mechanical contact with the stop 3. The movement of the stop 3 in the forward direction is limited by a damper 18, consisting for example of a rubber body, a steel spring, etc.

The first body 1 is a piston 1 performing a reciprocating motion centrally along the central line 4 with—as evident from FIG. 1—three different cross-sectional dimensions. The first piston 1 runs in an end seal opening or recess 11 in an end wall of the second piston 2, the second piston 2 being correspondingly provided with different cross-sectional dimensions. The casing or cylinder 5 is equipped with an inlet 7 for the supply of a drive medium 12, essentially under constant pressure, for instance compressed air which is supplied via a space confined with seals 8, 9 and a cowl 10, the diameter designated D1 on the drawing then being chosen somewhat larger than the diameter D2, whereby the cylinder 5 is forced by the pressure of the said drive medium 12 to be moved in the forward direction, to the right according to FIG. 1.

The percussive tool according to FIG. 1 is started for example by applying the chisel 6 against a workpiece (not shown in the drawing) which is to be chiseled, whereby the stop 3 is pushed in sufficiently to uncover the inlet 7 for the drive medium 12, enabling the drive medium 12 to flow into the space between the two pistons 1, 2 whereby the first piston 1 is driven towards the stop 3 in the forward direction at the same time as the second piston 2 is driven away from the stop 3 in the return direction. During these simultaneous, counter-directed movements of the pistons 1, 2, these reach the position where a certain leakage of drive medium 12 occurs on accout of the cross-sectional area of the first piston 1 being smaller than the cross-sectional area of the recess 11 in the second piston 2 so that a certain build up of pressure then commences in the space between the left end portion 21 (as seen in FIG. 1) of the piston 1 which closes essentially tightly against the inside surface of the cylinder 5, and the left end surface of the second piston 2, whereupon the right-hand surface of the first piston 2 strikes the stop 3 and generates a machining via the chisel 6, whereupon the build up of pressure in the space between pistons 1, 2, in the portion situated farthest to the left has not become so large that the second piston 2 receives an impulse to move in the forward direction at the same time as the first piston 1 strikes against the stop 3 and moves in the return direction and the said piston 1 subsequently moves so far to the left that an outlet 19 is uncovered and residual drive medium 12 is removed essentially at the same time as the second piston 2 strikes the stop 3, this process being repeated until the drive medium 12 is turned off.

In the embodiment shown by way of example in FIG. 1 the pistons 1 and 2 have esentially the same masses, for example 110 grams and 80 grams, and are moved with essentially the same stroke length but in reverse directions, but these conditions are obviously not essential and instead great differences may occur, for instance in the weight between the pistons 1 and 2 and between the different drive surfaces of the pistons 1 and 2.

In FIG. 1, the chisel hammer is shown in position before pressing in of the stop 3 and thus start of the hammer occurs and as shown in FIG. 2 is essentially the instant during the reciprocating movement when the first piston 1 strikes the stop 3. Also shown in FIG. 1 is that the chisel 6 etc. can be carried while attached to a seat 23 via roller bearings, ball bearings or needle bearings which work in the forward and return direction of the tool and that this seat 23 can in its turn possibly be carried in roller bearings in the cowl 10 via bearings 24 for the purpose of preventing transmission of small vibrations which for example on account of the motional friction against the cylinder or the casing 5 can be transmitted to the cowl 10.

Shown in FIG. 3 is a modified version of the chisel hammer according to FIGS. 1 and 2 in which the stop 3 has been modified and the first piston 1 strikes directly against the end of the chisel 6 while the second piston 2, via a spacer sleeve 25 strikes against a shoulder 26 on the chisel 6. The primary advantage of this embodiment is that the entire tool can be made shorter. Further, in this embodiment, a shoulder ring 27 has been provided on the second piston 2, the said ring 27 passing the inlet 7 and enabling the drive pressure to act against the larger surface of the second piston 2 in the forward direction whereby the machine receives help in starting, particularly in an upward directed position. A further shoulder 32 can be provided in the proximity of the inlet 7. Upon pressing in of the tool 6 and thus relative movement of the cylinder or the casing 5 the inlet 7 is uncovered and the machine starts. Upon removal of contact with the workpiece the cylinder or the casing 5 returns to the original position whereby the supply through the inlet 7 is blocked and the machine stops. The second piston 2 can as indicated above be provided on its outer surface with different surfaces in the forward and return directions with the objective of the second piston 2 endeavouring to be moved by the drive pressure 12 in the forward direction.

Shown in FIG. 4 is an embodiment of the attachment of the chisel in the hammer to permit rapid replacement of the chisel 6 by a different tool. The attachment is for example slotted or openable in some other appropriate manner and can be rolled to the right according to FIG. 4 whereupon the chisel 6 is removable and a new tool can be inserted, whereupon the ring 29 is rolled over the shoulder 30 of the tool, causing the ring 29 via the attachment to grip the shoulder 30 of the tool 6 and to retain the new tool in the intended position. Tool changing has by this means been accomplished very rapidly.

In the above, the invention has been described in relation to a chisel hammer but it is evident that it can be used in virtually all types of reciprocating movements, where devibration, equalization of forces, exchange of forces and balancing is desired or required. The invention is further applicable to a large number of percussive tools, of which by way of examples mention may be made of riveting hammers, pile driving hammers, rivet hammers, slag chisels, hewers, stone working tools, engraving pens, nail guns, etc.

I claim:

1. A device for depositing or impacting reciprocating movements of two pistons driven by a medium under constant pressure and applied between the two pistons, in the forward direction of a tool, comprising:

a cowl having a first opening for receiving a pressurized drive medium;

a cylindrical casing having a center axis, said casing being sealed in a bore in said cowl to define a first drive medium space between the outside of said casing and the inside wall of said cowl having said first opening, said casing having a second opening for admitting the drive medium to the interior of said casing;

a first piston and a second piston both arranged in the interior of said casing coaxially with said center axis;

said first piston having a first end part which runs outside the path of movement of said second piston and is sealed against the interior wall of said casing, a second end part of the first piston is arranged to move in sealing relation within a bore in the second piston, and an intermediate rod which connects said first end part and said second end part to one another;

said second piston being sealed against the interior wall of said casing and defining a second drive medium space between the outer circumference of said second piston and the interior wall of said casing having said second opening, said second piston having a third opening in its circumferential surface for admitting the drive medium within the bore of said second piston;

an end wall on said second piston having a seal opening coaxial with said center axis, said seal opening receiving said rod of said first piston;

wherein the cross-section along a first section of said rod which connects directly to said first end part is less than the cross-section of said seal opening so that pressurized drive medium inside said second piston can pass through said seal opening and move against said first end part of said first piston to move said first piston backwardly away from said second piston, and the cross-section of a second section of said rod which connects directly to said second end part of said first piston is dimensioned to run in sealing relation with said seal opening so that the pressurized drive medium can move against said second end part to move said first piston forwardly into said second piston until the first section of said rod is present at said seal opening.

2. A device as claimed in claim 1, wherein the first piston is, in the forward direction, provided with a first driving surface, which is essentially equal in size to a third driving surface in a return direction of the second piston, so that the first piston is driven in the forward direction at the same time as the second piston is driven in the return direction;

the cross-section of said rod of the first piston changes at said seal opening during movement of the first piston in the forward direction and movement of the second piston in the return direction, wherein a change of the driving surfaces of the pistons occurs, and a second driving surface in the return direction of the first piston is set to be essentially the same size as a fourth driving surface in the forward direction of the second piston, so that the first piston is driven in the return direction at the same time as the second piston is driven in the forward direction; and said first and said second pistons are of essentially the same weight.

3. A device according to claim 1 or 2, wherein said casing is sealed by means of seal members against said cowl surrounding said casing, drive medium is supplied to said first space between the casing, the seal members and the cowl, and the inside diameters of the cowl and the seal members are such that the casing tends to be moved by the drive medium in the forward direction.

4. A device as claimed in claim 1 or 2, wherein the casing is equipped with an outlet for said drive medium which outlet is positioned before a deadpoint of the first end part of the first piston.

5. A device as claimed in claim 1 or 2, including an impact member common to the two pistons, which impact member is centered in relation to the center axis and is mechanically connected to the tool, the impact member being positioned in the casing and sealed against the interior wall of the casing.

6. A device as claimed in claim 5, wherein upon pressing-in of said tool and, thus, movement of the impact member and of the second piston, said second opening in said casing for supply of drive medium is uncovered by said end wall of said second piston to admit the drive medium into said second drive medium space.

7. A device as claimed in claim 6, including a spacer sleeve at the tool end of the device for abutting against a shoulder of the tool inserted in the device, said second piston includes a sealing shoulder ring on its outer circumference, and upon pressing-in of said tool and, thus, movement of said spacer sleeve and the second piston, said second opening is uncovered when the second piston including the sealing shoulder ring is moved a certain distance.

* * * * *